US008499741B2

(12) United States Patent
Ishikawa et al.

(10) Patent No.: US 8,499,741 B2
(45) Date of Patent: Aug. 6, 2013

(54) THROTTLE CONTROL DEVICE

(75) Inventors: Michihiko Ishikawa, Kanagawa (JP); Riki Murasaka, Kanagawa (JP); Hiroyuki Shinohara, Kanagawa (JP)

(73) Assignee: Mikuni Corporation, Tokyo (JP)

( * ) Notice: Subject to any disclaimer, the term of this patent is extended or adjusted under 35 U.S.C. 154(b) by 264 days.

(21) Appl. No.: 13/067,340

(22) Filed: May 25, 2011

(65) Prior Publication Data

US 2011/0290213 A1 Dec. 1, 2011

(30) Foreign Application Priority Data

May 25, 2010 (JP) ..... 2010-119932

(51) Int. Cl.
*F02D 9/10* (2006.01)

(52) U.S. Cl.
USPC ..... 123/336; 123/337; 123/399; 123/400

(58) Field of Classification Search
USPC ..... 123/336, 337, 399, 400
See application file for complete search history.

(56) References Cited

U.S. PATENT DOCUMENTS

| | | | | |
|---|---|---|---|---|
| 6,935,308 | B1 * | 8/2005 | Nakamoto et al. | 123/395 |
| 7,066,142 | B2 * | 6/2006 | Hanasato | 123/336 |
| 7,461,630 | B2 * | 12/2008 | Maruo et al. | 123/397 |
| 2005/0155571 | A1 * | 7/2005 | Hanasato | 123/336 |
| 2005/0211220 | A1 * | 9/2005 | Matsuda | 123/336 |
| 2006/0042589 | A1 * | 3/2006 | Hanasato | 123/336 |
| 2008/0078355 | A1 * | 4/2008 | Maehara et al. | 123/399 |
| 2010/0170473 | A1 * | 7/2010 | Itagaki | 123/337 |

FOREIGN PATENT DOCUMENTS

JP 2002-256895 9/2002

* cited by examiner

*Primary Examiner* — Stephen K Cronin
*Assistant Examiner* — Joseph Dallo

(57) ABSTRACT

A throttle control device includes a throttle body having at least three air-intake passages aligned in line as being opened and closed respectively by a throttle valve, plural motors including a first motor which commonly operates the throttle valves placed at bilateral end sides among the throttle valves aligned in line and a second motor which operates a throttle valve placed at the inner side between the throttle valves at the bilateral end sides, and a transmitting portion which transmits operational force of the first motor to a first throttle shaft fixed to one throttle valve of the throttle valves at the bilateral end sides and to a second throttle shaft fixed to the other throttle valve thereof so as to rotate the first throttle shaft and the second throttle shaft in synchronization with each other.

6 Claims, 3 Drawing Sheets

FIG. 3 – Related Art
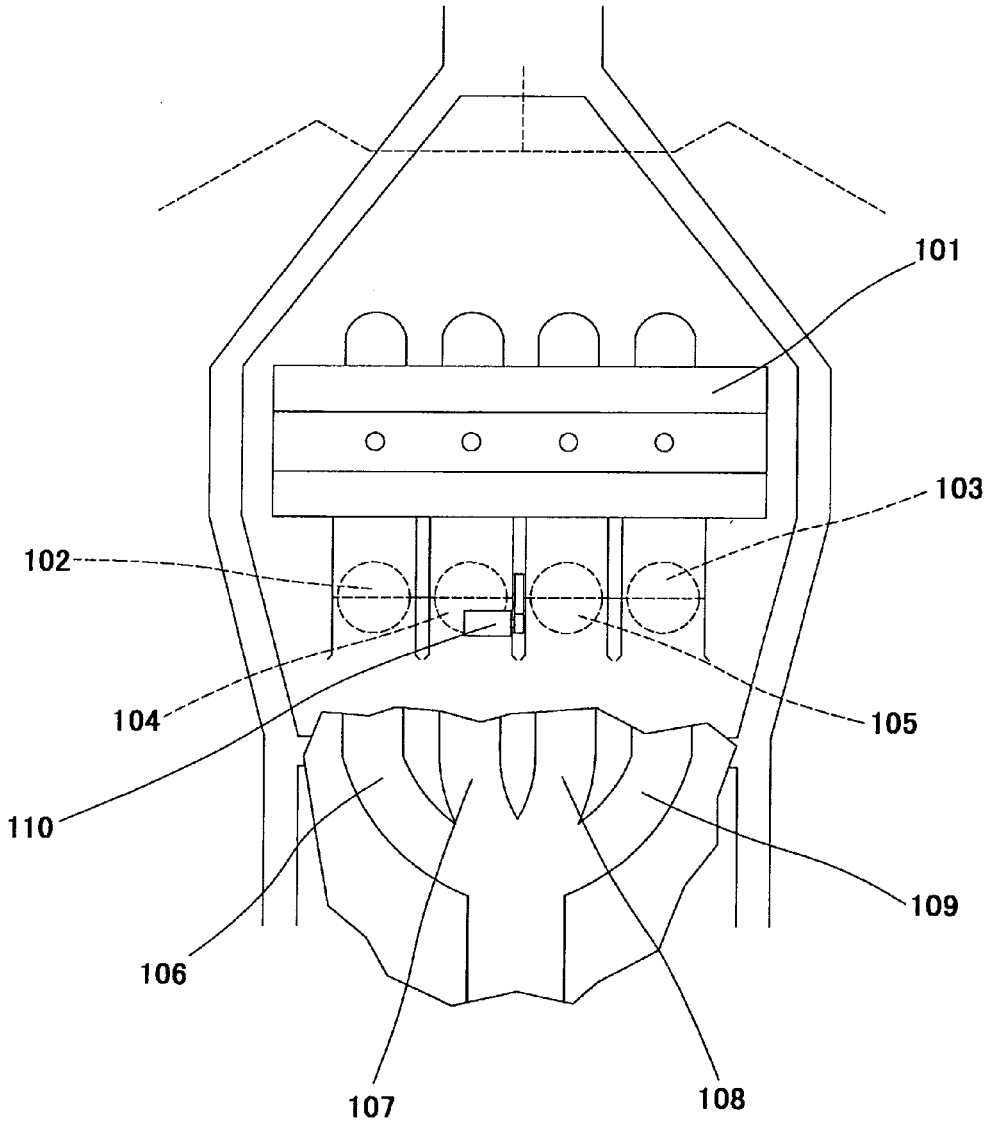

THROTTLE CONTROL DEVICE

CROSS-REFERENCE TO RELATED APPLICATIONS

This application claims the priority benefit of Japanese Patent Application No. 2010-119932, filed on May 25, 2010 in the Japanese Patent Office, the disclosure of which is incorporated herein by reference.

BACKGROUND

1. Field

The present disclosure relates to a throttle control device in which a motor is driven being based on an operational amount of a throttle grip and the like by a driver and an air-intake amount to an engine is controlled by controlling opening of a throttle valve with the motor.

2. Description of the Related Art

In the related art, there has been known a throttle control device in which an operational amount of a throttle grip and the like is detected by an accelerator sensor and throttle valve opening is controlled by driving a motor based on the operational amount as shown in, for example, Japanese Patent Publication No. 2002-256895, which discloses that a throttle valve placed at an outer side is operated by a motor commonly with a throttle valve adjacent thereto even in a case that four throttle valves are operated by two motors.

As illustrated in FIG. 3, when a throttle valve in the related art is mounted on an engine of a motorcycle, temperature of the vicinity of throttle valves 104, 105 placed at the inner side of a throttle body becomes relatively high compared to that of the vicinities of throttle valves 102, 103 placed at the bilateral outer sides of the throttle body as being cooled by external air.

Further, in a case that four exhaust pipes 106, 107, 108, 109 for respective cylinders are aggregated into a single pipe, two exhaust pipes 107, 108 placed at the inner side are shorter than two exhaust pipes 106, 109 placed at the outer sides owing to limitation of internal space of the motorcycle. Accordingly, there may be a case that air-intake inertia effect of cylinders at the inner side is different from that of cylinders at the outer sides. Here, when the throttle valves 102, 103 corresponding to the outer side cylinders and the throttle valves 104, 105 corresponding to the inner cylinders are controlled commonly by a single motor 110, there may be a fear of variation occurrence among air-fuel ratios of the respective cylinders.

SUMMARY

To address the above issues, the present disclosure provides a throttle control device capable of stably controlling air-fuel ratios of respective cylinders even when operational circumstances for inner cylinders are different from those for outer cylinders caused by positional arrangement within a motorcycle.

Additional aspects will be set forth in part in the description which follows and, in part, will be apparent from the description, or may be learned by practice of the disclosure.

A throttle control device of the present disclosure includes a throttle body having at least three air-intake passages aligned in line as being opened and closed respectively by a throttle valve, plural motors including a first motor which commonly operates the throttle valves placed at bilateral end sides among the throttle valves aligned in line and a second motor which operates a throttle valve placed at the inner side between the throttle valves at the bilateral end sides, and a transmitting portion which transmits operational force of the first motor to a first throttle shaft fixed to one throttle valve of the throttle valves at the bilateral end sides and to a second throttle shaft fixed to the other throttle valve thereof. Here, the first throttle shaft and the second throttle shaft are to be rotated in synchronization with each other owing to the transmitting portion.

Here, a first throttle gear to which operational force of the first motor is transmitted is fixed to the first throttle shaft and a second throttle gear to which operational force of the first motor is transmitted is fixed to the second throttle shaft. Further, the transmitting portion includes an engaging shaft arranged in parallel to the first throttle shaft and the second throttle shaft, a first engaging gear which is fixed to the engaging shaft as being engaged with the first throttle gear, a second engaging gear which is fixed to the engaging shaft as being engaged with the second throttle gear, and an intermediate gear which is fixed to a midpoint of the engaging shaft as being engaged with an output shaft of the first motor.

Alternatively, the transmitting portion may be formed as a shaft-shaped member integrated with the first throttle shaft and the second throttle shaft as being arranged at the air-intake upstream side or the air-intake downstream side against a third throttle shaft which is fixed to the throttle valve placed at the inner side.

According to the throttle control device of the present disclosure, since air-intake amounts of the air-intake passages at the outer sides and the air-intake amounts of the air-intake passages at the inner side are separately controlled, variation of air-fuel ratio control due to influence of temperature difference and the like between bilateral outer side cylinders and inner side cylinders can be suppressed and air-fuel ratio can be stably controlled for each cylinder.

BRIEF DESCRIPTION OF THE DRAWINGS

These and/or other aspects will become apparent and more readily appreciated from the following description of embodiments, taken in conjunction with the accompanying drawings of which:

FIG. 3 is a structural view of a throttle control device in the related art.

DESCRIPTION OF EMBODIMENTS

Figure 1:
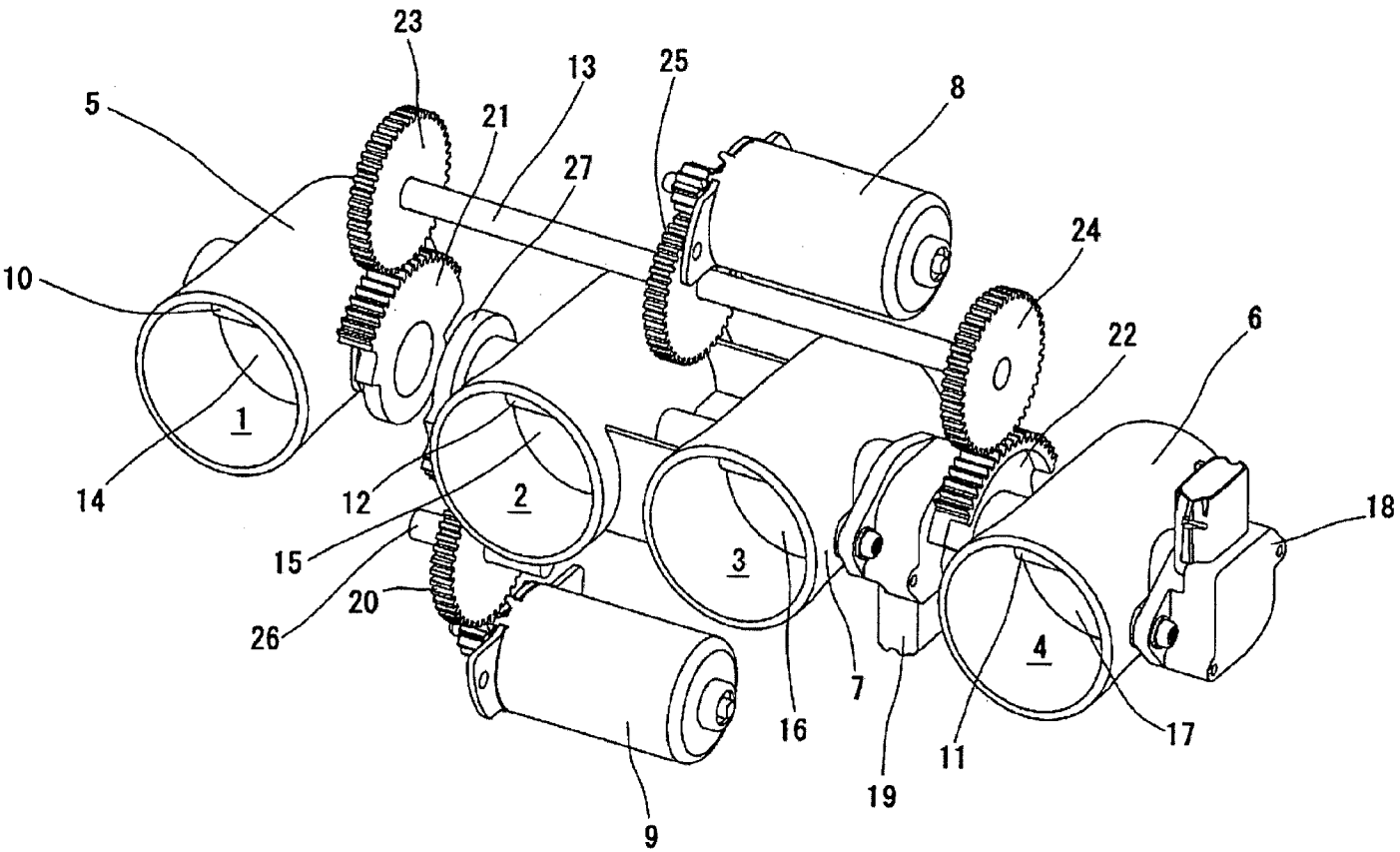
FIG. 1 is a structural view of a throttle control device according to an embodiment of the present disclosure.

Reference will now be made in detail to embodiments, examples of which are illustrated in the accompanying drawings, wherein like reference numerals refer to like elements throughout.

In the following, the structure of a throttle control device according to an embodiment of the present disclosure will be described with reference to FIG. 1. FIG. 1 is a perspective view of the throttle control device.

In the throttle control device according to the present embodiment, throttle bodies 5, 6, 7 are arranged to form intake passages 1, 2, 3, 4 respectively at the inside thereof to be communicated an in-line four-cylinder engine, for example. The throttle bodies 5, 6 are placed at the outer sides (i.e., at the bilateral end sides) and the throttle body 7 is placed at the inner side so as to be aligned in the lateral direction of a motorcycle. The throttle body 5 at one outer side includes a first throttle shaft 10 rotatably attached to the inside thereof and a first throttle valve 14 fixed to the first throttle shaft 10 to open and close the intake passage 1. The throttle body 6 at the other outer side includes a second throttle shaft 11 rotatably attached to the inside thereof and a fourth throttle valve 17 fixed to the second throttle shaft 11 to open and close the intake passage 4. The throttle body 7 at the inner side includes a third throttle shaft 12 rotatably attached to the inside thereof and a second throttle valve 15 and a third throttle valve 16 which are fixed to the third throttle shaft 12 respectively to open and close the intake passage 2 and the intake passage 3.

Opening of the first throttle valve 14 and the fourth throttle valve 17 is detected by a first throttle opening sensor 18 attached to an end part of the second throttle shaft 11 of the throttle body 16 at the other outer side. Opening of the second throttle valve 15 and the third throttle valve 16 is detected by a second throttle opening sensor 19 attached to an end part of the third throttle shaft 12 of the throttle body 7 at the inner side. A connector of the second throttle opening sensor 19 is oriented in the direction to be apart from a later-mentioned engaging shaft 13. Accordingly, wiring for connector connection can be facilitated. Here, a connector of the first throttle opening sensor 18 is oriented toward the engaging shaft 13 side. However, it is also possible to be oriented to the opposite direction. In this case, since the connector of the first throttle shaft 18 is to be oriented to the same direction of the connector of the second throttle opening sensor 19, wiring with the respective connectors can be simplified.

A first throttle gear 21 is attached to an end part of the first throttle shaft 10 at the one outer side. A second throttle gear 22 is attached to an end part of the second throttle shaft 11 at the other outer side as being opposite side to the first throttle opening sensor 18. Both the first throttle gear 21 and the second throttle gear 22 are attached as being faced to the throttle body 7 at the inner side. The first throttle gear 21 and the second throttle gear 22 are rotated as being engaged with the engaging shaft 13 having a first engaging gear 23 and a second engaging gear 24 at both ends thereof. The engaging shaft 13 is arranged in parallel to the first throttle shaft 10 and the second throttle shaft 11. An intermediate gear 25 is attached at some midpoint of the engaging shaft 13. The engaging shaft 13 is rotated while rotating the intermediate gear 25 by a first motor 8. When the engaging shaft 13 is rotated by the first motor 8 which is driven being based on a detection value of an accelerator opening sensor (not illustrated), the first throttle valve 14 is rotated via the first engaging gear 23 and the first throttle gear 21 and the fourth throttle valve 17 is rotated via the second engaging gear 24 and the second throttle gear 22. The first throttle valve 14 and the fourth throttle valve 17 being the throttle valves placed at the outer sides are rotated as being engaged with the engaging shaft 13 by driving the single first motor 8. Further, since the intermediate gear 25 is attached to the midpoint of the engaging shaft 13 at a position being the center between the first engaging gear 23 and the second engaging gear 24, degrees of torsion at both ends of the engaging shaft 13 are evened. Accordingly, the first throttle shaft 10 and the second throttle shaft 11 being the throttle shafts at the outer sides are reliably synchronized, so that the first throttle valve 11 and the fourth throttle valve 17 being the throttle valves at the outer sides can be opened and closed as being reliably synchronized. In this manner, a transmitting portion to transmit operational force of the first motor 8 to the first throttle shaft 10 and the second throttle shaft 11 is constituted with the engaging shaft 13, the first engaging gear 23, the second engaging gear 24 and the intermediate gear 25.

Regarding the throttle body 7 at the inner side, a third throttle gear 27 is attached to one end part of the third throttle shaft 12 and a second throttle opening sensor 19 is attached to the other end part thereof. The third throttle gear 27 is interlocked with an output shaft of a second motor 9 via a third engaging gear 20 which is rotated about an intermediate shaft 26. As described above, the second throttle valve 15 and the third throttle valve 16 are fixed to the third throttle shaft 12. Accordingly, the second throttle valve 15 and the third throttle valve 16 can be opened and closed as being reliably synchronized when the second motor 9 is driven being based on a detection value of the accelerator opening sensor (not illustrated). The first motor 8 is arranged at the opposite side to the second motor 9 as sandwiching the third throttle shaft 12. As described above, the throttle body 7 at the inner side includes the two intake passages having the second throttle valve 15 and the third throttle valve 16. However, there may be a case that only one intake passage with a throttle valve is provided. Further, it is also possible that the first motor 8 is arranged at the same side as the second motor 9 against the third throttle shaft 12. In this case, the engaging shaft 13 and the intermediate shaft 26 are arranged so as not to be contacted to each other as being aligned in the air-intake direction at the air-intake passages 1, 2, 3, 4. Here, since the first motor 8 and the second motor 9 are arranged at the same side against the air-intake passages 1, 2, 3, 4, space to be occupied at the opposite side thereto can be suppressed. In addition, cases (not illustrated) for the motors can be integrated and wiring for connecting with motor connectors (not illustrated) can be simplified. Further, it is also possible that the third engaging gear 20 is engaged with the third shaft 12 at some midpoint other than the end part thereof. Furthermore, it is also possible that the throttle bodies 5, 6, 7 are provided respectively with an injector or injectors (not illustrated) to inject fuel to the air-intake passages 1, 2, 3, 4 at the downstream side of the first throttle valve 14, the second throttle valve 15, the third throttle valve 16 and the fourth throttle valve 17. Here, the throttle bodies 5, 6, 7 are formed separately in the present embodiment. However, it is also possible that the throttle bodies 5, 6, 7 are integrally formed.

The first throttle valve 14 and the fourth throttle valve 17 being the throttle valves at the outer sides are opened and closed by the single motor 8. The second throttle valve 15 and the third throttle valve 16 are opened and closed by the other single motor 9. Thus, since air-intake amounts of the air-intake passages 1, 4 at the outer sides and the air-intake amounts of the air-intake passages 2, 3 at the inner side are controlled by the separate motors, variation of air-fuel ratio control due to influence of temperature difference and the like between outer side cylinders and inner side cylinders can be suppressed and air-fuel ratio can be stably controlled for each cylinder.

Figure 2:
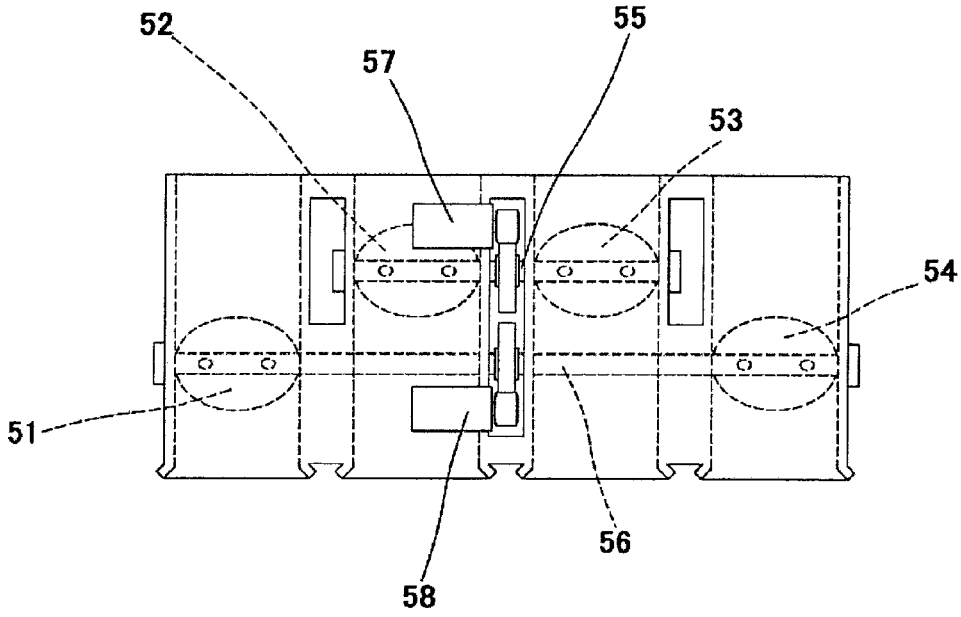
FIG. 2 is a structural view of a throttle control device according to another embodiment of the present disclosure.

Next, the structure of a throttle control device according to another embodiment of the present disclosure will be described with reference to FIG. 2. FIG. 2 is a structural view of the throttle control device according to another embodiment. Here, description on the same structure as that of the above embodiment will be skipped.

A first throttle valve 51 and a fourth throttle valve 54 being the throttle valves at the outer sides are fixed to an upstream throttle shaft 56. That is, the first throttle shaft and the second throttle shaft are integrated into the upstream side throttle shaft 56. Further, the transmitting portion to transmit operational force of a first motor 58 to the first throttle shaft and the second throttle shaft is integrated into the upstream side throttle shaft 56, as well. A second throttle valve 52 and a third throttle valve 53 being the throttle valves at the inner side are fixed to a downstream throttle shaft 55. The upstream throttle shaft 56 is rotated by the first motor 58 and the downstream throttle shaft 55 is rotated by a second motor 57. The upstream throttle shaft 56 is placed at the upstream side against the downstream throttle shaft 55 in the air-intake direction.

Thus, since air-intake amounts of the air-intake passages at the outer sides and the air-intake amounts of the air-intake passages at the inner side are controlled by the separate motors, variation of air-fuel ratio control due to influence of temperature difference and the like between outer side cylinders and inner side cylinders can be suppressed and air-fuel ratio can be stably controlled for each cylinder.

Here, the similar effects can be obtained even when the throttle valves at the outer sides are fixed to the downstream throttle shaft and the throttle valves at the inner side are fixed to the upstream throttle shaft.

The present disclosure effectively functions as a throttle control device to control an air amount to be supplied to an engine having three cylinders or more for a motorcycle and the like.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A throttle control device to control an air-intake amount for an engine, comprising:

a throttle body including at least three air-intake passages aligned in line, each air-intake passage being opened and closed by a throttle valve;

a plurality of motors including a first motor which commonly operates the throttle valves placed at bilateral end sides among the throttle valves aligned in line and a second motor which operates a throttle valve placed at the inner side between the throttle valves at the bilateral end sides; and a transmitting portion which transmits operational force of the first motor to a first throttle shaft fixed to one throttle valve of the throttle valves at the bilateral end sides and to a second throttle shaft fixed to the other throttle valve of the throttle valves at the bilateral end sides so as to rotate the first throttle shaft and the second throttle shaft in synchronization with each other.

2. The throttle control device according to claim 1, further comprising:

a first throttle gear to which operational force of the first motor is transmitted, the first throttle gear being fixed to the first throttle shaft;

a second throttle gear to which operational force of the first motor is transmitted, the second throttle gear being fixed to the second throttle shaft; and the transmitting portion includes an engaging shaft arranged in parallel to the first throttle shaft and the second throttle shaft, a first engaging gear which is fixed to the engaging shaft as being engaged with the first throttle gear, a second engaging gear which is fixed to the engaging shaft as being engaged with the second throttle gear, and an intermediate gear which is fixed to a midpoint of the engaging shaft as being engaged with an output shaft of the first motor.

3. The throttle control device according to claim 1, wherein the transmitting portion is a shaft-shaped member integrally formed with the first throttle shaft and the second throttle shaft, the shaft-shaped member being arranged at the air-intake upstream side or the air-intake downstream side against a third throttle shaft which is fixed to the throttle valve placed at the inner side.

4. The throttle control device according to claim 1, wherein the throttle body comprises three throttle bodies arranged to form at least three intake passages, two of the throttle bodies being placed at the outer sides and forming one intake passage each, and the remaining throttle body being placed at the inner side and forming one or more intake passages.

5. The throttle control device according to claim 4, further comprising:

a first throttle opening sensor to detect opening of the throttle valves of the throttle bodies on the outer sides; and a second throttle opening sensor to detect opening of the throttle valve of the throttle body at the inner side.

6. The throttle control device according to claim 5, further comprising a third throttle shaft which is fixed to the throttle valve placed at the inner side, wherein the first throttle opening sensor is attached to an end part of the second throttle shaft, and the second throttle opening sensor is attached to an end part of the third throttle shaft.

* * * * *